US011317481B2

(12) United States Patent
Yamamoto

(10) Patent No.: US 11,317,481 B2
(45) Date of Patent: Apr. 26, 2022

(54) SUPPORTING STRUCTURE FOR INDUCTION HEATING COIL, AND INDUCTION HEATING DEVICE

(71) Applicant: Koyo Thermo Systems Co., Ltd., Nara (JP)

(72) Inventor: Ryosuke Yamamoto, Nara (JP)

(73) Assignee: Koyo Thermo Systems Co., Ltd., Nara (JP)

( * ) Notice: Subject to any disclaimer, the term of this patent is extended or adjusted under 35 U.S.C. 154(b) by 272 days.

(21) Appl. No.: 16/466,867

(22) PCT Filed: Nov. 29, 2017

(86) PCT No.: PCT/JP2017/042851
§ 371 (c)(1),
(2) Date: Jun. 5, 2019

(87) PCT Pub. No.: WO2018/105461
PCT Pub. Date: Jun. 14, 2018

(65) Prior Publication Data

US 2020/0068670 A1 Feb. 27, 2020

(30) Foreign Application Priority Data

Dec. 8, 2016 (JP) ..... JP2016-238352

(51) Int. Cl.
*H05B 6/24* (2006.01)
*H05B 6/44* (2006.01)
*F27D 11/12* (2006.01)

(52) U.S. Cl.
CPC ..... *H05B 6/44* (2013.01); *F27D 11/12* (2013.01)

(58) Field of Classification Search
CPC ..... H05B 6/36; H05B 6/44; F27D 11/12
See application file for complete search history.

(56) References Cited

U.S. PATENT DOCUMENTS 4,639,279 A * 1/1987 Chatterjee ..... C21D 9/32 148/573
5,197,081 A * 3/1993 Fishman ..... H05B 6/22 219/647

(Continued)

FOREIGN PATENT DOCUMENTS

CN 104470017 A * 3/2015
CN 104470017 A 3/2015
DE 10025004 A1 11/2001
EP 1138422 A2 10/2001

(Continued)

OTHER PUBLICATIONS

International Search Report issued in PCT/JP2017/042851; dated Mar. 6, 2018.

(Continued)

*Primary Examiner* — Helena Kosanovic
*Assistant Examiner* — Lawrence H Samuels
(74) *Attorney, Agent, or Firm* — Studebaker & Brackett PC

(57) ABSTRACT

Provided is a supporting structure for an induction heating coil and an induction heating device in which a surface of an induction heating coil is not formed of a coating film for insulation that generates a gas, and movement of the induction heating coil when the induction heating coil is energized can be suppressed. A supporting structure 4 of an induction heating device 1 includes a supporting column 20 and a plurality of restricting members 21. The supporting column 20 is disposed at an outer side in a radial direction of winding portions 13 of the induction heating coil 3, and extends in an axial direction S1. The restricting members 21 receive the induction heating coil 3 to restrict movement of the induction heating coil 3 in the axial direction S1 in an insulated state, and are supported by the supporting column 20.

6 Claims, 9 Drawing Sheets

(56) References Cited

U.S. PATENT DOCUMENTS

| | | | | |
|---|---|---|---|---|
| 5,668,827 | A * | 9/1997 | Goy | F27B 14/063 373/156 |
| 5,901,170 | A * | 5/1999 | Peysakhovich | H05B 6/24 373/155 |
| 6,680,466 | B2 * | 1/2004 | Rabe | B23B 31/1179 219/632 |
| 2001/0024020 | A1 | 9/2001 | Rabe | |
| 2001/0054471 | A1 | 12/2001 | Kelch | |
| 2010/0243644 | A1 * | 9/2010 | Terashima | C21D 9/60 219/645 |
| 2011/0210117 | A1 * | 9/2011 | Yonenaga | H05B 6/105 219/634 |
| 2012/0156886 | A1 * | 6/2012 | Shirako | C23C 16/481 438/706 |
| 2012/0300806 | A1 * | 11/2012 | Prabhu | F27B 14/20 373/145 |
| 2017/0353995 | A1 * | 12/2017 | Yamada | F27D 99/0006 |

FOREIGN PATENT DOCUMENTS

| | | | | |
|---|---|---|---|---|
| JP | S51-115038 | U | | 9/1976 |
| JP | S59-138097 | A | | 8/1984 |
| JP | 2003-305549 | A | | 10/2003 |
| JP | 2014-093471 | A | | 5/2014 |
| JP | 2019083137 | A | * | 5/2019 |

OTHER PUBLICATIONS

Office Action issued in JP 2017-562376; mailed by the Japanese Patent Office dated May 7, 2019.

An Office Action mailed by the Japanese Patent Office dated Oct. 15, 2019, which corresponds to Japanese Patent Application No. 2017-562376 and is related to U.S. Appl. No. 16/466,867.

A Request for Inspection of a file matter record submitted to the Japanese Patent Office dated Jul. 18, 2019, which corresponds to Japanese Patent Application No. 2017-562376 and is related to U.S. Appl. No. 16/466,867.

* cited by examiner

SUPPORTING STRUCTURE FOR INDUCTION HEATING COIL, AND INDUCTION HEATING DEVICE

TECHNICAL FIELD

The present invention relates to a supporting structure for an induction heating coil, and an induction heating device.

BACKGROUND ART

An induction heating device to inductively heat a workpiece (object to be worked) such as a gear is known. The induction heating device includes an induction heating coil. The induction heating coil is formed by spirally winding a copper wire. In some cases, a glass tape is wound around a surface of this induction heating coil, and further, a surface of the glass tape is insulation-coated with varnish.

Patent Document 1 discloses a configuration in which an induction heating coil is arranged around an outer circumference of a crucible-type molten metal container. Around the induction heating coil, coil supporting columns are disposed, and by support beams extending from the coil supporting columns, the induction heating coil is supported.

CITATION LIST

Patent Document

Patent Document 1: Japanese Unexamined Patent Application Publication No. 2003-305549

SUMMARY OF THE INVENTION

Technical Problem

However, when the surface of the induction heating coil is coated, at the time of induction heating, due to radiation heat applied to the induction heating coil from a workpiece at 1000° C. or higher, a coating portion emits smoke while generating a degassing action due to heating. As a result, the surface of the induction heating coil is discolored black, etc. Here, it is possible that, at the time of manufacturing of the induction heating coil, in a manufacturing plant for the induction heating coil, the insulation coating film is heated to a high temperature, and accordingly, the degassing step is completed before shipment from the plant. However, in order to complete this measure in a short time, an induction heating coil assembly must be exposed to hot air or heated in an oven, etc., and this is not practical. Further, generation of smoke at the time of use of the induction heating coil after shipment from the plant can be suppressed, however, discoloration of the insulation coating film still occurs.

In a case of an induction heating coil having a plurality of windings, at the time of induction heating, an internal force such as a Lorentz force is generated at winding portions of the induction heating coil. This internal force acts as a force to contract the induction heating coil having a coil spring shape, and accordingly changes positions of the respective portions of the induction heating coil having no surface with coating film. Even in an induction heating coil with one winding, the coil is displaced in an axial direction. If positions of the respective portions of the induction heating coil change, the magnetic flux distribution of the induction heating coil also changes. As a result, variation occurs in the heating state of the workpiece. Therefore, it is necessary to constantly maintain the positions of the respective portions of the induction heating coil. However, in the configuration described in Patent Document 1, a detailed configuration to restrict displacement in an axial direction of each portion of the induction heating coil is not disclosed.

In view of the above-described circumstances, an object of the present invention is to provide a supporting structure for an induction heating coil and an induction heating device, in which a surface of an induction heating coil is not formed of a coating film for insulation that generates a gas, and it is possible to suppress the occurrence of movement of the induction heating coil when the induction heating coil is energized.

Solution to Problem (1) In order to solve the above-described problem, a supporting structure for an induction heating coil according to an aspect of the present invention includes a supporting column disposed at an outer side in a radial direction of winding portion of an induction heating coil and extending in an axial direction of the induction heating coil, and a restricting member which receives the induction heating coil in an insulated state to restrict movement of the induction heating coil in the axial direction, and supported by the supporting column.

With this configuration, it is configured that the restricting member supported by the supporting column restricts movement of the induction heating coil. With this configuration, movement (displacement in the axial direction) such as contraction of the induction heating coil can be reliably prevented by the restricting member. Accordingly, short-circuiting between winding portions of the induction heating coil can be prevented, so that it is not necessary to harden the surface of the induction heating coil by coating film such as varnish or glass tape for insulation in the induction heating coil, and therefore, it is not necessary to form the surface of the induction heating coil of a coating film that generates a gas. For this reason, a supporting structure for an induction heating coil, in which a surface of an induction heating coil is not formed of a coating film for insulation that generates a gas, and it is possible to suppress the occurrence of movement of the induction heating coil when the induction heating coil is energized, can be realized.

(2) The induction heating coil may have a plurality of windings, and the restricting member may be disposed between portions adjacent to each other in the axial direction of the induction heating coil.

With this configuration, since a restricting member is interposed between portions adjacent to each other in the axial direction of the induction heating coil, changes in relative positions of these portions adjacent to each other in the axial direction can be more reliably restricted. Further, by disposing a restricting member between portions adjacent to each other in the axial direction of the induction heating coil, a supporting structure for an induction heating coil can be disposed in a gap portion between the portions adjacent to each other of the induction heating coil. Accordingly, a bulging amount of the supporting structure for an induction heating coil in a radial direction of the induction heating coil can be made smaller, so that the shape of the entire induction heating coil and the supporting structure can be made more compact.

(3) The induction heating coil may include a spiral coil main body having the winding portions and an extended portion extending outward in the radial direction from the coil main body, and a plurality of the extended portions may be provided along the axial direction, and the restricting member may be disposed between a plurality of the extended portions adjacent to each other in the axial direction.

With this configuration, it is configured that the restricting member can receive the induction heating coil at a position away from the coil main body that generates a magnetic flux to heat a workpiece. Accordingly, it is configured that the restricting member is more reliably restricted from influencing the magnetic flux for induction heating. In addition, the extended portions and the restricting member can be disposed at positions that radiation heat from a workpiece heated by induction heating hardly reaches. Accordingly, a heat load on the restricting member can be made smaller, so that the life of the supporting structure can be lengthened.

(4) The restricting member may be formed into a cylindrical shape and fitted to the supporting column.

With this configuration, by the restricting member, the supporting column can be protected. Accordingly, a load to be applied to the supporting column by radiation heat, etc., from a workpiece can be reduced. In addition, the restricting member and the supporting column can be disposed more compactly as a whole.

(5) The supporting structure for an induction heating coil may further include an insulating member interposed between the supporting column and the extended portion.

With this configuration, the extended portion of the induction heating coil and the supporting column can be insulated by the insulating member. Accordingly, the induction heating coil can be prevented from short-circuiting.

(6) A plurality of the insulating members may be provided, the insulating members adjacent to each other in the axial direction may be butted against each other, and a position of a butting portion between the plurality of insulating members may be deviated in the axial direction from positions of the extended portions of the induction heating coil.

With this configuration, the butting portion between the insulating members and the extended portions of the induction heating coil can be disposed as away as possible from each other. Accordingly, in the induction heating coil, short-circuiting caused by the butting portion can be more reliably prevented. Further, the insulating member is divided into the plurality of insulating members, so that bias of heat distribution in each insulating member is small. Therefore, a thermal impact (internal force) caused by bias of heat in each insulating member can be made small.

(7) In the induction heating coil, a workpiece disposing region in which a workpiece is disposed may be set, a plurality of the insulating members may be provided, and some of the insulating members may be juxtaposed to the workpiece disposing region in the radial direction, and the others of the insulating members may be positionally deviated from the workpiece disposing region in the axial direction.

In this case, some of the insulating members juxtaposed to the workpiece disposing region in the radial direction are subjected to radiation heat from a workpiece and reach a high temperature when the workpiece is heated by induction heating. However, some of the insulating members reach a high temperature in their entirely, so that bias of heat distribution inside them can be made small. Therefore, a thermal impact (internal force) due to bias of heat inside some of the insulating members can be made small. Some insulating members other than the insulating members are disposed further away from the workpiece disposing region. Therefore, an amount of radiation heat applied to the other insulating members from the workpiece is small, so that the other insulating members can be restricted from reaching a high temperature in their entirely, and inside, bias of heat distribution is small. Therefore, a thermal impact (internal force) due to bias of heat inside the other insulating members is small. As a result, a load caused by heat is small in each of the plurality of insulating members, so that the life of the supporting structure can be made longer.

(8) The supporting structure for an induction heating coil may further include a stay configured to support the supporting column and to be supported by a predetermined base member.

In this case, the stay can support the induction heating coil via the supporting column and the restricting member. Accordingly, the configuration to restrict movement of the induction heating coil and the configuration to support the induction heating coil can be made the same. Therefore, the supporting structure for an induction heating coil can be made simpler.

(9) In order to solve the above-described problem, an induction heating device according to an aspect of the present invention includes an induction heating coil, and the supporting structure configured to support the induction heating coil.

In this case, an induction heating device in which a surface of an induction heating coil is not formed of a coating film for insulation that generates a gas, and it is possible to suppress the occurrence of movement of the induction heating coil when the induction heating coil is energized, can be realized.

Effect of the Invention

According to the present invention, a surface of an induction heating coil is not formed of a coating film for insulation that generates a gas, and it is possible to prevent the occurrence of movement of the induction heating coil when the induction heating coil is energized.

BRIEF DESCRIPTION OF THE DRAWINGS

FIG. 6 are schematic views of a principal portion to describe another modification.

FIG. 9 are views to describe still another modification.

EMBODIMENT OF THE INVENTION

Hereinafter, an embodiment of the present invention is described with reference to the drawings.

Figure 1:
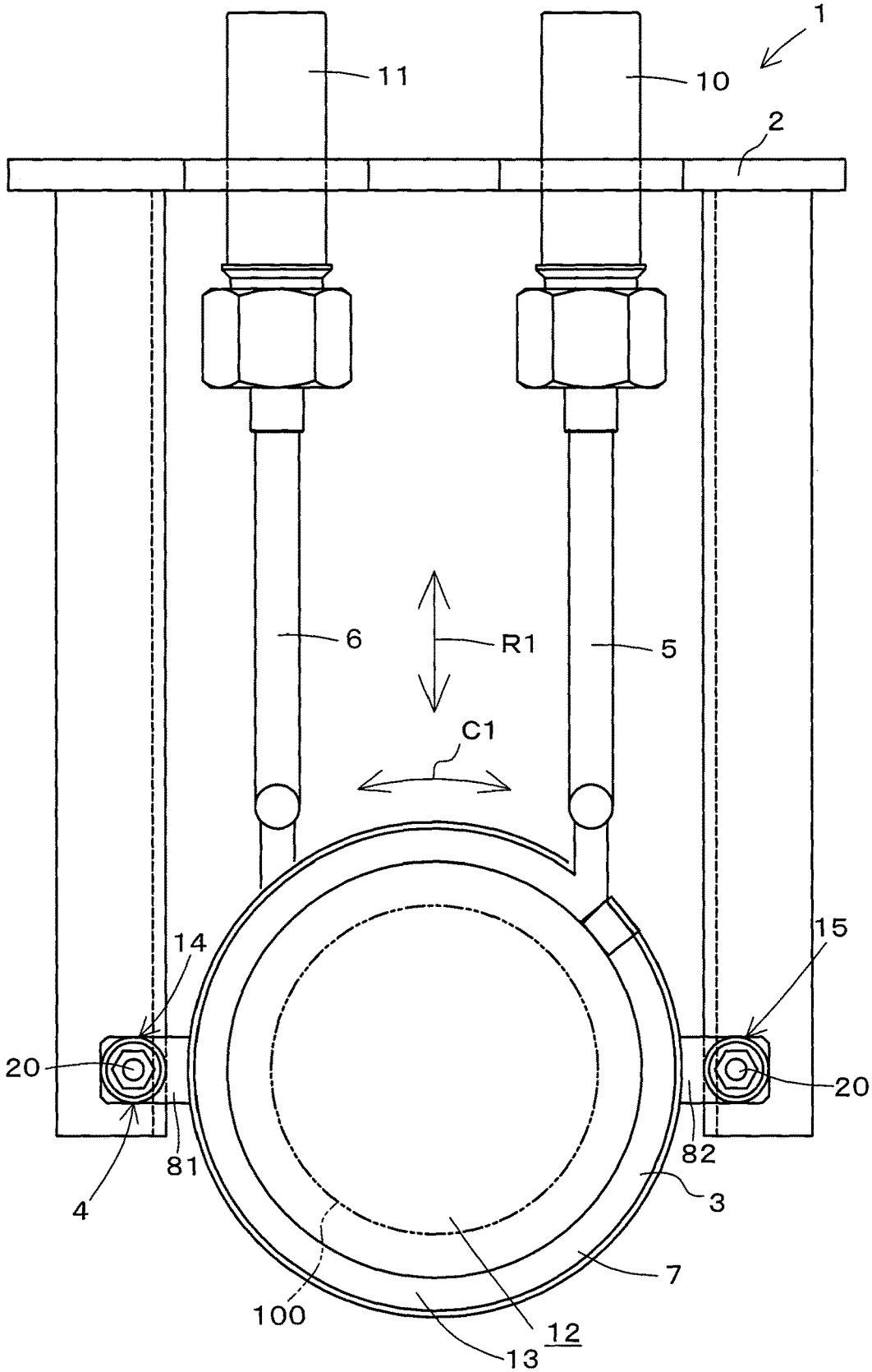
FIG. 1 is a plan view of an induction heating device according to an embodiment of the present invention.
Figure 2:
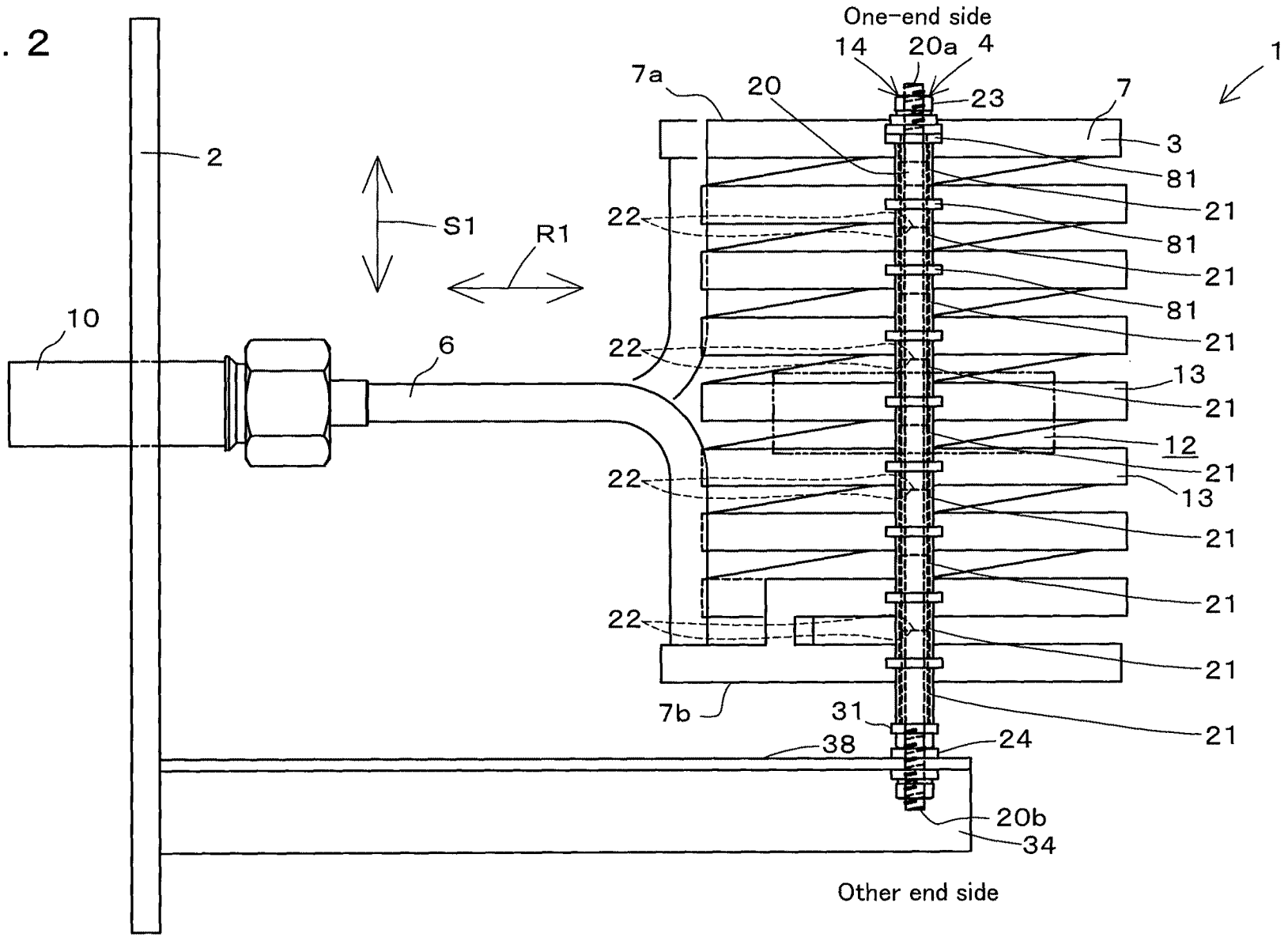
FIG. 2 is a side view of the induction heating device.
Figure 3:
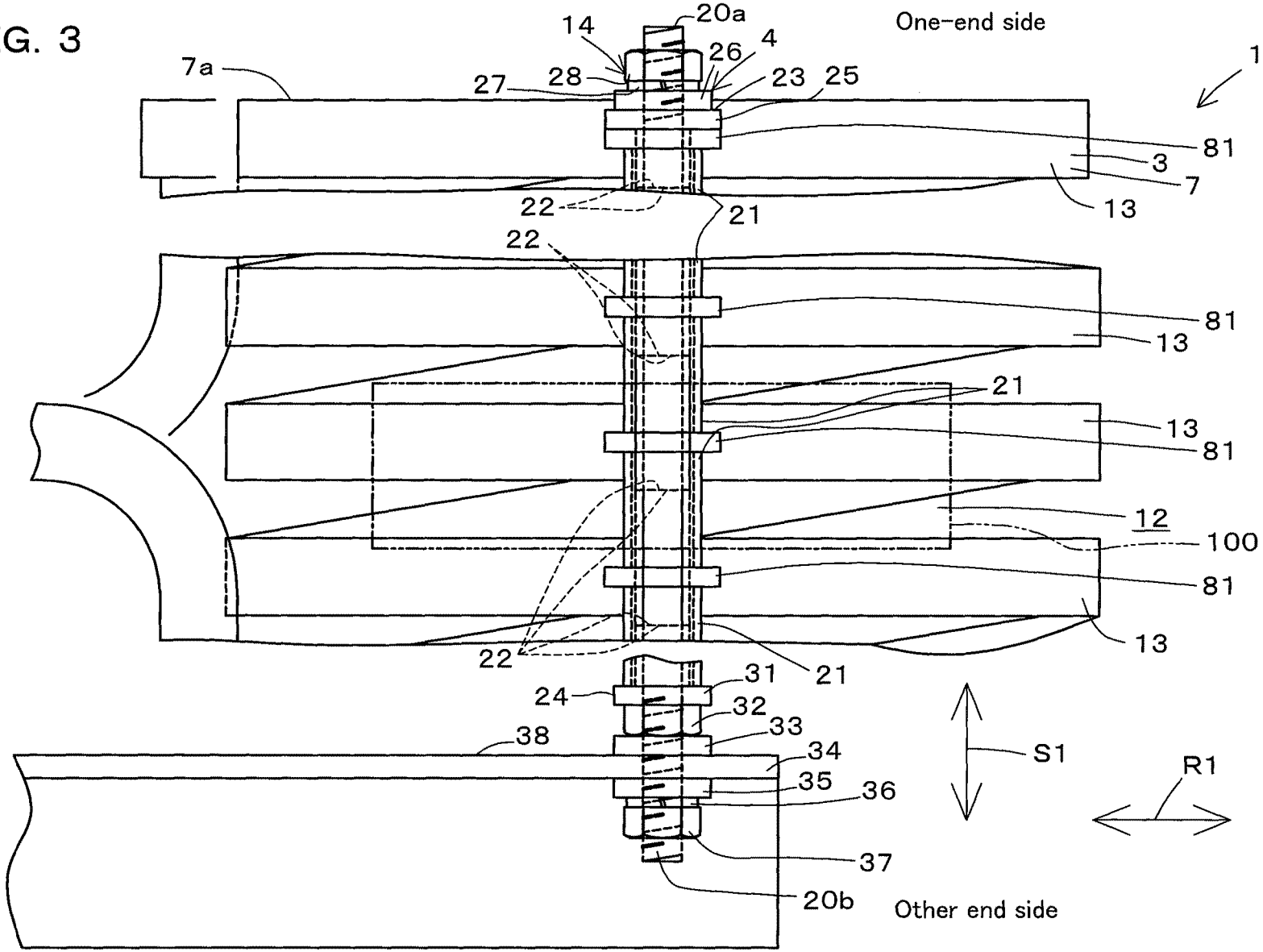
FIG. 3 is a side view enlarging a principal portion around a supporting structure in an induction heating coil.
Figure 4:
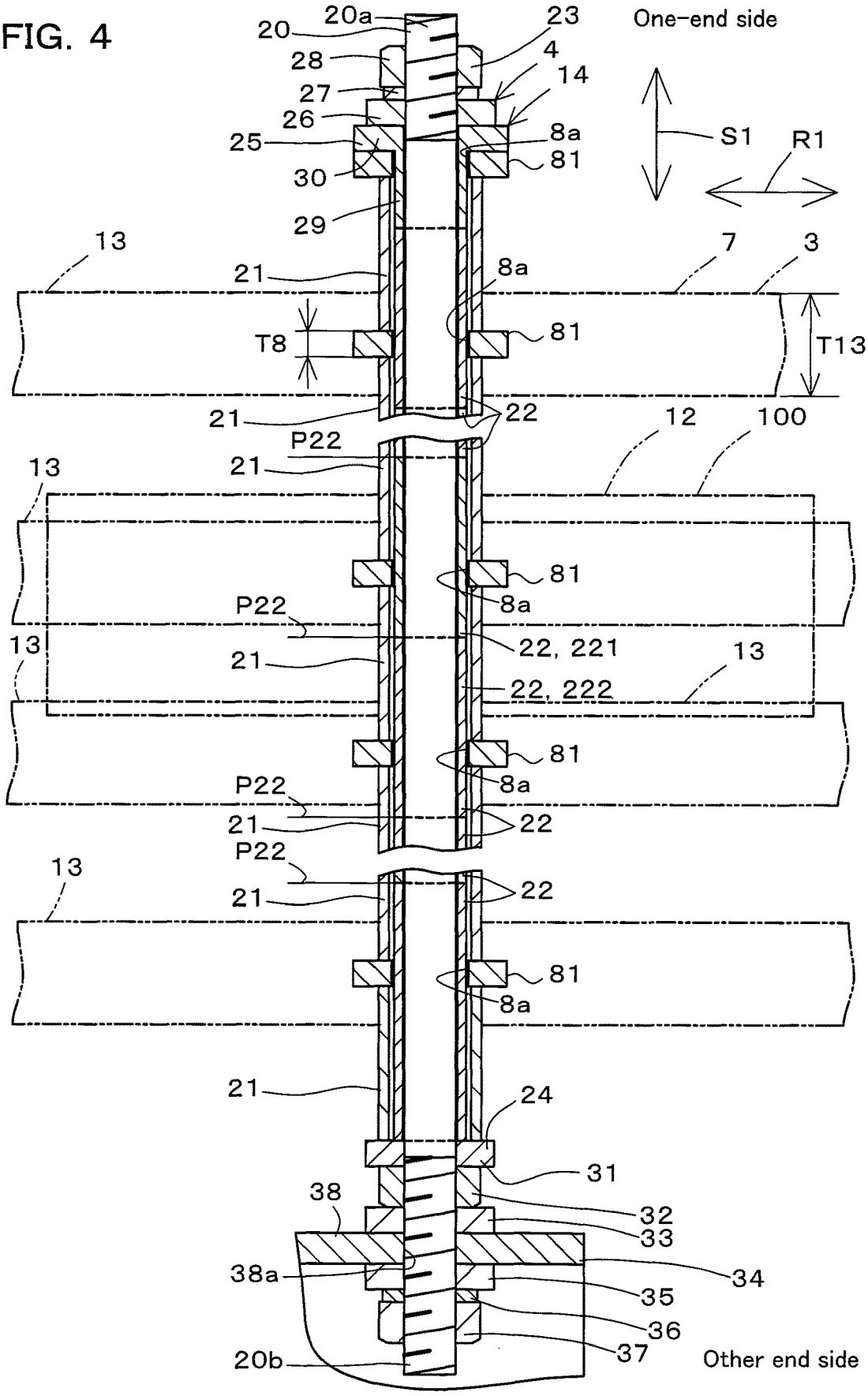
FIG. 4 is a sectional view enlarging the principal portion around the supporting structure.

FIG. 1 is a plan view of an induction heating device 1 according to an embodiment of the present invention. FIG. 2 is a side view of the induction heating device 1. FIG. 3 is a side view enlarging a principal portion around a supporting structure 4 in the induction heating coil 3. FIG. 4 is a sectional view enlarging the principal portion around the supporting structure 4. In FIG. 4, some members are shown by alternate long and two short dashed lines as imaginary lines.

With reference to FIG. 1 to FIG. 4, in the present embodiment, description is given based on a state where an axial direction S1 of the induction heating coil 3 is set in an up-down direction, however, another setting is also possible. The orientation of the induction heating coil 3 is not limited. In the present embodiment, an axial direction S1, a radial direction R1, and a circumferential direction C1 of the induction heating coil 3 are simply referred to as "axial direction S1," "radial direction R1", and "circumferential direction C1," respectively.

The induction heating device 1 is provided to apply a heat treatment to a workpiece 100 by heating the workpiece 100 by high-frequency heating. An example of this heat treatment may be quenching treatment, etc. A detailed example of heating treatment to be performed with the induction heating device 1 is not particularly limited. In the present embodiment, the workpiece 100 is a member with magnetism, and in the present embodiment, a gear as a metal component. The workpiece 100 to be heated by the induction heating device 1 may be any member as long as the member can be heated by induction heating.

The induction heating device 1 includes abase member 2, an induction heating coil 3, and a supporting structure 4 to support the induction heating coil 3.

The base member 2 is provided as a base member of the induction heating device 1, and extends vertically. In the present embodiment, the base member 2 is formed of a side wall member. The base member 2 may constitute a portion of a housing (not illustrated). When the base member 2 constitutes a portion of a housing, a box-shaped housing including the base member 2 may form a housing chamber that houses the induction heating coil 3.

The induction heating coil 3 is configured to generate a magnetic flux that passes through the workpiece 100 by being given AC power. The induction heating coil 3 is formed by using a conductive material (metal material) such as copper. The induction heating coil 3 is formed to be hollow, and a coolant passage is formed inside the induction heating coil 3. This coolant passage extends from one end to the other end of the induction heating coil 3, and is connected to a cooler not illustrated.

The induction heating coil 3 includes a first relay portion 5 and a second relay portion 6, a coil main body 7, and extended portions 81 and 82 extending outward in a radial direction R1 of the induction heating coil 3 from the coil main body 7.

The first relay portion 5 forms a coolant inlet into the induction heating coil 3, and forms a portion to be connected to a power supply terminal not illustrated. The second relay portion 6 forms a coolant outlet from the induction heating coil 3, and forms a portion to be connected to the power supply terminal not illustrated.

The first relay portion 5 and the second relay portion 6 are disposed adjacent to each other. Each of the first relay portion 5 and the second relay portion 6 is formed into, for example, an L shape in a side view. One ends of the first relay portion 5 and the second relay portion 6 are formed linearly, and respectively connected to corresponding joint tubes 10 and 11 by using nuts. The joint tubes 10 and 11 extend so as to penetrate through the base member 2. The first relay portion 5 has an intermediate portion bent at substantially 90 degrees, and extends from this intermediate portion toward one end 7*a* (in the present embodiment, upper end) of the coil main body 7. The second relay portion 6 has an intermediate portion bent at substantially 90 degrees, and extends from this intermediate portion toward the other end 7*b* (in the present embodiment, lower end) of the coil main body 7.

The coil main body 7 is formed into a spiral shape with a predetermined thickness, and in the present embodiment, has a plurality of windings. A circular cylindrical space surrounded by the coil main body 7 is configured to house the workpiece 100, and configured so that the workpiece 100 is surrounded by the coil main body 7. The coil main body 7 has predetermined pitches, and spirally extends at the predetermined pitches. One end 7*a* of the coil main body 7 is connected to the first relay portion 5. The other end 7*b* of the coil main body 7 is connected to the second relay portion 6.

A workpiece disposing region 12 is set in relation to the coil main body 7. The workpiece disposing region 12 is a region in which the workpiece 100 is disposed when the workpiece 100 is inductively heated by the induction heating coil 3, and is provided in the space surrounded by the coil main body 7. The workpiece disposing region 12 is provided at a substantially center of the coil main body 7 in the axial direction S1. In the present embodiment, at one end 7*a* and the other end 7*b* in the axial direction S1 in the coil main body 7, the workpiece disposing region 12 is not set. The workpiece 100 is heated in the workpiece disposing region 12 while being placed on a mounting seat not illustrated.

The coil main body 7 includes a plurality of winding portions 13. Each winding portion 13 is formed in a range of substantially 360 degrees in the circumferential direction C1 of the coil main body 7, and by the plurality of successive winding portions 13, the coil main body 7 is formed. Each winding portion 13 is provided with extended portions 81 and 82.

The extended portions 81 and 82 are respectively formed into tabular shapes extending outward in the radial direction of the coil main body 7 from corresponding winding portions 13, and in the present embodiment, formed into rectangular shapes. A thickness T8 of each of the extended portions 81 and 82 in the axial direction S1 is set to be, in the present embodiment, less than a thickness T13 of the winding portion 13 of the coil main body 7. The thickness T8 may be equal to or more than the thickness T13, however, from the viewpoint of prevention of short-circuiting, the thickness T8 is preferably less than the thickness T13. The extended portions 81 and 82 are disposed at even pitches (180-degree pitches in the present embodiment) on the respective winding portions 13. The number of extended portions for each winding portion 13 is not limited to two, and may be one or three or more. The extended portion 81 is fixed by, for example, brazing to a corresponding winding portion 13. The extended portions 81 and 82 are only required to be fixed to corresponding winding portions 13, and the method of fixing to the winding portions 13 is not limited.

The plurality of extended portions 81 provided on the coil main body 7 are juxtaposed in the axial direction S1. Similarly, the plurality of extended portions 82 provided on the coil main body 7 are juxtaposed in the axial direction S1. In each of the extended portions 81 and 82, a through hole portion 8*a* (the through hole portions 8*a* of the extended portions 82 are not illustrated) is formed. The through hole portion 8*a* is a portion through which a supporting column 20 described below penetrates. The induction heating coil 3 configured as described above is supported by a supporting structure 4.

The supporting structure 4 is configured to support the induction heating coil 3 while restricting movements (displacements in the axial direction, such as expanding and contracting displacements, etc.) of the respective portions of the induction heating coil 3 when the induction heating coil 3 is energized. In the present embodiment, the supporting structure 4 is disposed at an outer side of the coil main body 7 in the radial direction R1 in order to reduce radiation heat to be applied from the workpiece 100 while preventing short-circuiting of the induction heating coil 3 and reducing an influence on a magnetic field to be applied to the workpiece 100.

The supporting structure 4 includes a plurality of units 14 and 15.

The units 14 and 15 are disposed at outer sides of the winding portions 13 of the coil main body 7 in the radial direction R1. The unit 14 is configured to support the second relay portion 6 side of the induction heating coil 3. The unit 15 is configured to support the first relay portion 5 side of the induction heating coil 3. In the present embodiment, the units 14 and 15 are disposed at even pitches in the circumferential direction C1, and configured to be subjected to loads from corresponding extended portions 81 and 82. The units 14 and 15 have like configuration to each other. Therefore, hereinafter, a detailed configuration of the unit 14 is described, and detailed description of the unit 15 is omitted.

The unit 14 includes a supporting column 20, a plurality of restricting members 21 disposed so as to overlap the extended portions 81, a plurality of insulating members 22, a one-end side unit 23, and the other end side unit 24.

The supporting column 20 is a joint member to join the respective portions of the entire unit 14 to each other. The supporting column 20 is provided as a column member disposed at an outer side in the radial direction of the winding portions 13 of the induction heating coil 3 and extending in the axial direction S1 of the induction heating coil 3. In the present embodiment, a direction parallel to the axial direction S1 of the induction heating coil 3 is also referred to as the "axial direction S1". The supporting column 20 is a bolt member with male threaded portions 20*a* and 20*b* formed on its both ends in the axial direction S1. An intermediate portion of the supporting column 20 may have a male threaded portion, or may be formed into a circular cylindrical shape or a polygonal column shape.

The supporting column 20 is formed by using a metal material such as a stainless steel material, and configured to be elastically deformable and plastically deformable. The supporting column 20 is preferably formed of a material with comparatively high resistance against brittle fracture, such as a metal. The supporting column 20 may have conductivity, or at least an outer surface of the supporting column may be formed of an insulating material. The supporting column 20 is more preferably non-magnetic. When the supporting column 20 is non-magnetic, the supporting column 20 can be restricted from being inductively heated by a magnetic field generated by the induction heating coil 3. As such a material, in the present embodiment, an austenite stainless steel material is used.

The supporting column 20 penetrates through the through hole portions 8*a* of the respective extended portions 81 of the induction heating coil 3. A diameter of the supporting column 20 is set to be less than a diameter of the through hole portion 8*a* so that the supporting column 20 does not come into direct contact with the induction heating coil 3. To this supporting column 20, a plurality of insulating members 22 are fitted.

By being interposed between the supporting column 20 and the extended portion 81, the insulating member 22 is configured to prevent short-circuiting between the supporting column 20 and the extended portion 81. A plurality of insulating members 22 are provided, and are disposed along the axial direction S1. The number of insulating members 22 is not particularly limited, and may be one or two or more. The number of insulating members 22 is preferably equal to or more than the number of extended portions 81.

The respective insulating members 22 have the same configuration. Accordingly, it is possible to reduce labor in manufacturing the insulating members 22. The insulating members 22 are formed into circular cylindrical shapes in the present embodiment. The insulating members 22 may be formed into half-moon shapes or other shapes as long as they can restrict direct contact between the supporting column 20 and the extended portions 81. The insulating members 22 are formed of an insulating material. In the present embodiment, as a material of the insulating members 22, a ceramic material such as alumina is used. When the insulating members 22 are made of ceramic, a heatproof temperature of the insulating members 22 can made extremely high. As a material of the insulating members 22, a hard-insulating material capable of resisting radiation heat from the workpiece 100 is preferable. The insulating members 22 may be formed by coating a surface of a conductive member with an insulating material.

In the present embodiment, regarding the insulating members 22, at least one insulating member 22 is provided per one extended portion 81. Each insulating member 22 is fitted to the supporting column 20, and penetrates through the corresponding through hole portion 8*a* of the extended portion 81. An inner diameter of the insulating member 22 is set to be larger than an outer diameter of the supporting column 20. An outer diameter of the insulating member 22 is set to be smaller than an inner diameter of the through hole portion 8*a* of the extended portion 81.

In the present embodiment, the insulating members 22 adjacent to each other in the axial direction S1 are butted against each other. That is, the insulating members 22 are disposed in a stacked manner along the axial direction S1, and the insulating members 22 adjacent to each other in the axial direction S1 are in direct contact with each other. A position P22 of the butting portion (contact portion) between the insulating members 22 adjacent to each other in the axial direction S1 is deviated in the axial direction S1 from positions of the extended portions 81 of the induction heating coil 3. In the present embodiment, in the axial direction S1, the position P22 of the butting portion is disposed at a substantially center between the extended portions 81 and 81 adjacent to each other. The insulating member 22 has a length in the axial direction S1 set larger than the thickness T8 of the extended portion 81. In the present embodiment, in the axial direction S1, the length of the insulating member 22 is set the same to a sum of the length of one restricting member 21 and the thickness T8 of one extended portion 81.

As described above, in the induction heating coil 3, a workpiece disposing region 12 in which the workpiece 100 is disposed is set. The insulating members 221 and 222 as a part of the insulating members 22 are juxtaposed to the workpiece disposing region 12 in the radial direction R1

(positionally overlap in the axial direction S1). The insulating members 22 other than the insulating members 221 and 222 are positionally deviated in the axial direction S1 from the workpiece disposing region 12. In the present embodiment, about a half portion of the two insulating members 221 and 222 are juxtaposed to the workpiece disposing region 12 in the radial direction R1. When inductively heating the workpiece 100, radiation heat from the workpiece 100 is transferred to the insulating members 221 and 222 while spreading from the workpiece 100 to the surrounding. Therefore, in the axial direction S1, even if the entirety of the workpiece disposing region 12 and the entireties of the insulating members 221 and 222 are not positionally matched, heat from the workpiece 100 is substantially evenly transferred to the entireties of the insulating members 221 and 222.

It is only required that at least a part of each insulating member 221, 222 is juxtaposed to the workpiece disposing region 12 in the radial direction R1. In the present embodiment, a form in which the two insulating members 221 and 222 are juxtaposed to the workpiece disposing region 12 in the radial direction R1 is described by way of example, however, another form is also possible. For example, one or three or more insulating members 22 may be juxtaposed to the workpiece disposing region 12 in the radial direction R1. A plurality of restricting members 21 are disposed so as to surround the insulating members 22 as described above.

The restricting members 21 are members that are subjected to a load of the induction heating coil 3 in an electrically-insulated state to restrict movement of the induction heating coil 3 in the axial direction S1, and are supported by the supporting column 20 via the one-end side unit 23 and the other end side unit 24. The restricting members 21 define positions of the respective extended portions 81 and the winding portions 13 in the axial direction S1. The restricting members 21 are provided to be plural in number, and are disposed along the axial direction S1. In the present embodiment, the restricting members 21 are provided the same number as the extended portions 81. In the present embodiment, restricting members 21 other than one restricting member 21 on the other end 7*b* side of the coil main body 7 are disposed between portions adjacent to each other in the axial direction S1 of the induction heating coil 3, that is, between two extended portions 81 and 81. In the present embodiment, the restricting member 21 on the other end 7*b* side of the coil main body 7 is disposed between one extended portion 81 and an end portion presser member 31 described below.

The respective restricting members 21 have the same configuration. Accordingly, it is possible to reduce labor in manufacturing the insulating members 21. The restricting members 21 are formed into circular cylindrical shapes in the present embodiment. The restricting members 21 may be formed into half-moon shapes or other shapes as long as they can restrict a distance change in the axial direction S1 between the two extended portions 81 and 81 (two winding portions 13 and 13). The restricting members 21 are formed of the same material as that of the insulating members 22 described above, and at least surfaces of the restricting members 21 are formed of an insulating material. In the present embodiment, the material of the restricting members 21 and the material of the insulating members 22 are the same. Accordingly, the manufacturing costs for the restricting members 21 and the insulating members 22 can be reduced.

The respective restricting members 21 are fitted to the supporting column 20 so as to surround the insulating members 22, and are in contact with the surfaces of the respective corresponding extended portions 81. An outer diameter of the restricting member 21 is set to be larger than an inner diameter of the through hole portion 8*a*, and in the present embodiment, both of an inner circumferential portion and an outer circumferential portion of the restricting member 21 are in contact with a surface of a corresponding extended portion 81. An inner diameter of the restricting member 21 is set to be larger than an outer diameter of the insulating member 22, and the restricting members 21 are suppressed from coming into contact with the insulating members 22. With the configuration described above, the restricting members 21 and the extended portions 81 are alternately disposed, the insulating members 22 are disposed inside the restricting members 21 and the extended portions 81, and further, the supporting column 20 is inserted into the insides of the insulating members 22.

The insulating members 22 and the restricting members 21 configured as described above are joined to the supporting column 20 and the induction heating coil 3 by the one-end side unit 23 and the other-end side unit 24.

The one-end side unit 23 is provided at the one end 7*a* of the coil main body 7 in the axial direction S1, and is configured to fix one end portion of the supporting column 20 to one end 7*a* of the coil main body 7. The supporting column 20 penetrates through the one-end side unit 23. In the present embodiment, the one-end side unit 23 has a screw coupling structure, but is not limited to this structure and is only required to have a configuration capable of fixing one end portion of the supporting column 20 and the one end 7*a* of the coil main body 7 to each other.

The one-end side unit 23 includes an end portion presser member 25, a washer 26, a spring washer 27, and a nut 28 as a fixing member.

The end portion presser member 25 is configured to receive the extended portion 81 on one end 7*a* side of the coil main body 7, and the insulating member 22 disposed on one end in the axial direction S1 among the plurality of insulating members 22. The end portion presser member 25 is formed of the same material as that of the insulating member 22, and at least an outer surface of the end portion presser member 25 is formed of an insulating material.

The end portion presser member 25 is formed into a cylindrical shape, and includes, in the present embodiment, a cylindrical portion 29 and a flange portion 30.

The cylindrical portion 29 is formed into a circular cylindrical shape, and butted against the insulating member 22. An inner diameter and an outer diameter of the cylindrical portion 29 are preferably set the same as a corresponding inner diameter and a corresponding outer diameter of the insulating member 22 respectively. The cylindrical portion 29 passes through the insides of the restricting member 21 and the extended portion 81 adjacent to the one-end side unit 23. At one end of the cylindrical portion 29, the flange portion 30 is disposed.

The flange portion 30 is an annular plate portion, and is received by the extended portion 81 at one end 7*a* of the coil main body 7. The washer 26 is disposed to be overlaid on the flange portion 30. The washer 26 is subjected to an axial force from the nut 28 via the spring washer 27. The nut 28 is screw-coupled to the male threaded port ion 20*a* on one end portion of the supporting column 20. The other end side unit 24 is disposed so as to cooperate with the one-end side unit 23.

The other end side unit 24 is provided on the other end 7*b* side of the coil main body 7 in the axial direction S1, and is configured to fix the other end portion of the supporting column 20 to the coil main body 7 and the stay 34. The supporting column 20 penetrates through the other end side unit 24. In the present embodiment, the other end side unit 24 has a screw coupling structure, but is not limited to this structure and is only required to be configured to fix the other end portion of the supporting column 20 and the other end 7*b* of the coil spring 7 and the stay 34 to each other.

The other end side unit 24 includes an end portion presser member 31, a nut 32 as a fixing member, a washer 33, a stay 34, a washer 35, a spring washer 36, and a nut 37 as a fixing member.

The end portion presser member 31 is configured to receive the extended portion 81 on the other end 7*b* side of the coil main body 7 via the restricting member 21 disposed on the other end in the axial direction S1 among the plurality of restricting members 21. The end portion presser member 31 is formed of the same material as that of the insulating members 22, and at least an outer surface of the end portion presser member 31 is formed of an insulating material. The end portion presser member 31 is formed of an annular plate member, and receives the restricting member 21 and the insulating member 22 positioned in the vicinity of the other end side in the axial direction S1 of the coil main body 7. An inner diameter of the end portion presser member 31 is set substantially the same as an outer diameter of the supporting column 20.

In the present embodiment, the end portion presser member 25 of the one-end side unit 23 is configured to include the cylindrical portion 29 and the flange portion 30, and the end portion presser member 31 of the other end side unit 24 is configured to be formed of a tabular member (portion corresponding to the flange portion 30). However, another configuration is also possible. For example, the dispositions of the end portion presser member 25 of the one-end side unit 23 and the end portion presser member 31 of the other end side unit 24 may be reversed.

The nut 32 is screw-coupled to the male threaded portion 20*b* of the supporting column 20 while being overlaid on the end portion presser member 31. The nut 32 cooperates with the nut 28 of the one-end side unit 23 to fasten the spring washer 27, the washer 26, the end portion presser member 25, the plurality of extended portions 81, the plurality of insulating members 22 and the plurality of restricting members 21, and is, further, fixed to the supporting column 20. Accordingly, coupling among the supporting column 20, the insulating members 22, the restricting members 21, and the coil main body 7 is realized by using the one-end side unit 23 and the other end side unit 24.

The nut 32 is joined to the stay 34 via the washer 33.

The stay 34 is a member that supports the supporting column 20, and is supported by the base member 2. The stay 34 is formed of a structural member such as a metal member or a synthetic resin member. A portion where the stay 34 is disposed is the outside of the coil main body 7. The stay 34 is preferably away from a magnetic field generated by the coil main body 7, and is preferably formed of a non-magnetic material such as austenite-based stainless steel. The stay 34 is formed of, for example, an L-shaped stainless steel plate. The stay 34 has a tabular portion 38 extending horizontally. In this tabular portion 38, a through hole portion 38*a* to be fitted to the supporting column 20 is formed. One end portion of the stay 34 is fixed to the base member 2. The stay 34 is sandwiched by the washers 33 and 35.

The washer 35 is received by the nut 37 via the spring washer 36. The nut 37 is screw-coupled to the male threaded portion 20*b* of the supporting column 20. With this configuration, between the nuts 32 and 37, the stay 34 is fastened to the supporting column 20. It is configured that the nut 37 couples the stay 34 and the supporting column 20, however, the nut 37 does not contribute to coupling of the coil main body 7 to the insulating members 22 and the restricting members 21. With this configuration, it is possible that a sub-assembly in which the coil main body 7 and the supporting structure 4 are coupled to each other is assembled, and then, this sub-assembly is fixed to the stay 34.

As described above, according to the present embodiment, it is configured that the restricting members 21 supported by the supporting column 20 restrict movement such as expansion and contraction of the induction heating coil 3. With this configuration, movement (displacement in the axial direction) such as contraction of the induction heating coil 3 can be reliably prevented by the restricting members 21. Accordingly, short-circuiting between the winding portions 31 of the induction heating coil 3 can be prevented, so that it is not necessary to harden the surface of the induction heating coil 3 by coating film such as varnish and glass tape, etc., for insulation in the induction heating coil 3, and therefore, it is not necessary to form the surface of the induction heating coil 3 of a coating film that generates a gas. In this way, the supporting structure 4 for the induction heating coil 3 in which the surface of the induction heating coil 3 is not formed of a coating film for insulation that generates a gas, and movement of the induction heating coil 3 can be suppressed when the induction heating coil 3 is energized, can be realized.

For example, when an insulating member is interposed between the entire area of the opposing surfaces of the adjacent winding portions of the induction heating coil, the insulating member must be formed into a shape for its exclusive use along the shapes of the winding portions. Therefore, when the diameters of the winding portions of the induction heating coil are changed, the shape of the insulating member must be changed as well. On the other hand, according to the present embodiment, it is configured that the restricting members 21 receive a part (extended portions 81 and 81) of the induction heating coil 3, and the supporting structure 4 including such restricting members 21 is formed by assembling a plurality of members. In this configuration, even if the diameters of the winding portions 13 of the induction heating coil 3 are changed, the configuration of the supporting structure 4 does not need to be changed, and the supporting structure 4 can be applied as is to the induction heating coil 3 with a different diameter.

According to the present embodiment, the induction heating coil 3 has a plurality of windings, and the restricting member 21 is disposed between the extended portions 81 and 81 adjacent to each other in the axial direction S1 of the induction heating coil 3. With this configuration, by interposing the restricting member 21 between the extended portions 81 and 81 adjacent in the axial direction S1 of the induction heating coil 3, changes in relative position in the axial direction S1 of the extended portions 81 and 81 (winding portions 13 and 13) adjacent to each other can be more reliably restricted. Further, by disposing the restricting member 21 between the extended portions 81 and 81 adjacent to each other in the axial direction S1 of the induction heating coil 3, the supporting structure 4 for the induction heating coil 3 can be disposed in gap portions between the extended portions 81 and 81 adjacent to each other in the induction heating coil 3. Accordingly, a bulging amount of the supporting structure 4 of the induction heating coil 3 in the radial direction R1 of the induction heating coil 3 can be made smaller. Therefore, the shape of the entire induction heating coil 3 and the supporting structure 4 can be made more compact.

According to the present embodiment, it is configured that the restricting members 21 can receive the induction heating coil 3 at a position away from the coil main body 7 that generates a magnetic flux to heat the workpiece 100. Accordingly, it is configured that the restricting members 21 are more reliably restricted from influencing a magnetic flux for induction heating. In addition, the extended portions 81 and the restricting members 21 can be disposed at positions that radiation heat from the workpiece 100 heated by induction heating is less likely to reach. Accordingly, a head load on the restricting members 21 can be made smaller, so that the life of the supporting structure 4 can be made longer.

According to the present embodiment, the restricting members 21 are formed into cylindrical shapes and fitted to the supporting column 20. With this configuration, the supporting column 20 can be protected by the restricting members 21. Accordingly, a load to be applied to the supporting column 20 by radiation heat, etc., from the workpiece 100 can be reduced. In addition, the restricting members 21 and the supporting column 20 can be disposed more compactly as a whole.

According to the present embodiment, the extended portions 81 of the induction heating coil 3 and the supporting column 20 can be insulated by the insulating members 22. Accordingly, the induction heating coil 3 can be prevented from short-circuiting.

According to the present embodiment, in the axial direction S1, the position P22 of the butting portion between the insulating members 22 adjacent to each other is deviated in the axial direction S1 from posit ions of the extended portions 81 of the induction heating coil 3. With this configuration, the butting portion of the insulating members 22 and the extended portions 81 of the induction heating coil 3 can be disposed away from each other as possible from each other. Accordingly, in the induction heating coil 3, short-circuiting due to butting between the insulating members 22 can be prevented. Further, due to division into the plurality of insulating members 22, bias of heat distribution inside each insulating member 22 is small. Therefore, a thermal impact (internal force) caused by bias of heat inside each insulating member 22 can be made small.

According to the present embodiment, the insulating members 221 and 222 are juxtaposed to the workpiece disposing region 12 in the radial direction R1. The insulating members 22 other than the insulating members 221 and 222 are disposed so as to positionally deviate from the workpiece disposing region 12 in the axial direction S1. In this case, the insulating members 221 and 222 juxtaposed to the workpiece disposing region 12 in the radial direction R1 are subjected to radiation heat from the workpiece 100 and reaches a high temperature when the workpiece 100 is heated by induction heating. However, the insulating members 221 and 222 reach a high temperature as a whole, so that bias of heat distribution inside the insulating members 221 and 222 can be made small. Therefore, a thermal impact (internal force) caused by bias of heat inside each of the insulating members 221 and 222 can be made small. The insulating members 22 other than the insulating members 221 and 222 are disposed more distant from the workpiece disposing region 12. Therefore, an amount of radiation heat applied to the insulating members 22 other than the insulating members 221 and 222 from the workpiece 100 is small, so that these insulating members 22 do not reach a high temperature as a whole, and bias of heat distribution inside these insulating members is small. Therefore, a thermal impact (internal force) caused by bias of heat inside the insulating members 22 other than the insulating members 221 and 222 is small. As a result, a load caused by heat is small in each of the plurality of insulating members 22, so that the life of the supporting structure 4 can be made longer.

According to the present embodiment, the stay 34 can support the induction heating coil 3 via the supporting column 20 and the restricting members 21. Accordingly, a configuration to restrict contraction of the induction heating coil 3 and a configuration to support the induction heating coil 3 can be made the same. Therefore, the supporting structure 4 of the induction heating coil 3 can be made simpler.

The embodiment of the present invention is described above, however, the present invention is not limited to the embodiment described above. The present invention can be variously changed within the scope described in claims. Hereinafter, differences from the embodiment described above are mainly described, and like components are designated by like reference signs, and detailed description of the like components is omitted.

Figure 5:
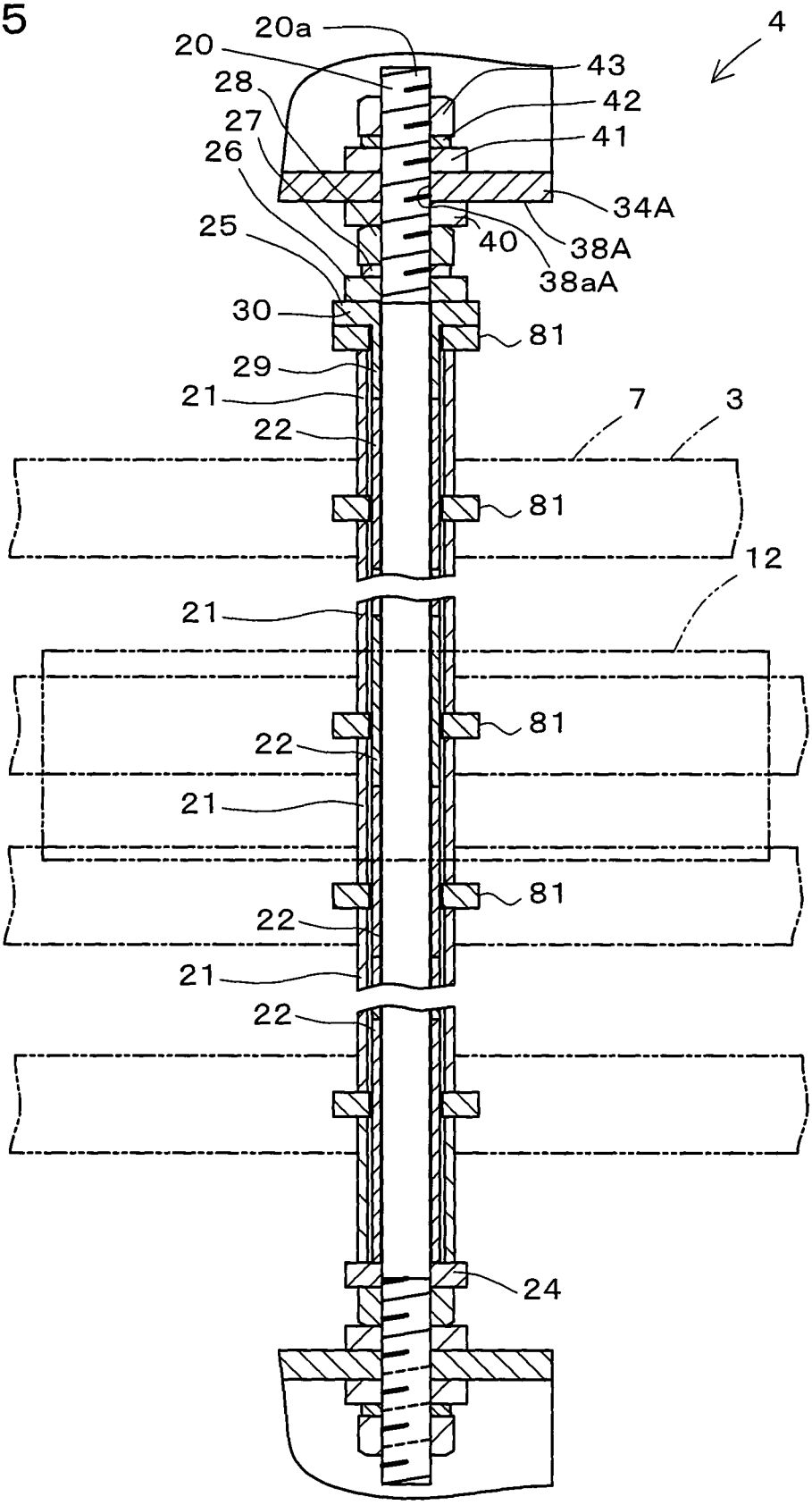
FIG. 5 is a schematic view of a principal portion to describe a modification, partially shown in section.

(1) In the embodiment described above, a form in which the coil main body 7 is supported by the stay 34 provided on the other end side (lower end side) of the induction heating coil 3 in the axial direction S1 is described by way of example. However, another form is also possible. For example, as shown in FIG. 5, a stay 34A may be further provided in addition to the stay 34. The stay 34A is disposed on one end side of the induction heating coil 3 in the axial direction S1. The stay 34A is formed into, for example, like shape as that of the stay 34, and has a tabular portion 38A.

In the tabular portion 38A, a through hole portion 38*aA* that the male threaded portion 20*a* of the supporting column 20 penetrates through is formed. The stay 34A is sandwiched by a pair of washers 40 and 41. A spring washer 42 is overlaid on one washer 41, and further, a nut 43 is screw-coupled to the male threaded portion 20*a* of the supporting column 20. Accordingly, by the nuts 28 and 43, the stay 34A is fixed to the supporting column 20. The stay 34A is fixed to the base member 2 (not illustrated in FIG. 5) by using a fixing member such as a screw member. In this case, the induction heating coil 3 can be supported at both ends (in the present embodiment, supported at both upper and lower ends) by the stays 34 and 34A. Therefore, the supporting structure 4 can support the induction heating coil 3 in a more stable posture.

In the modification described above, it is also possible that the stay 34 is omitted, and the induction heating coil 3 is supported in a suspended posture by the stay 34A.

Figure 6A:
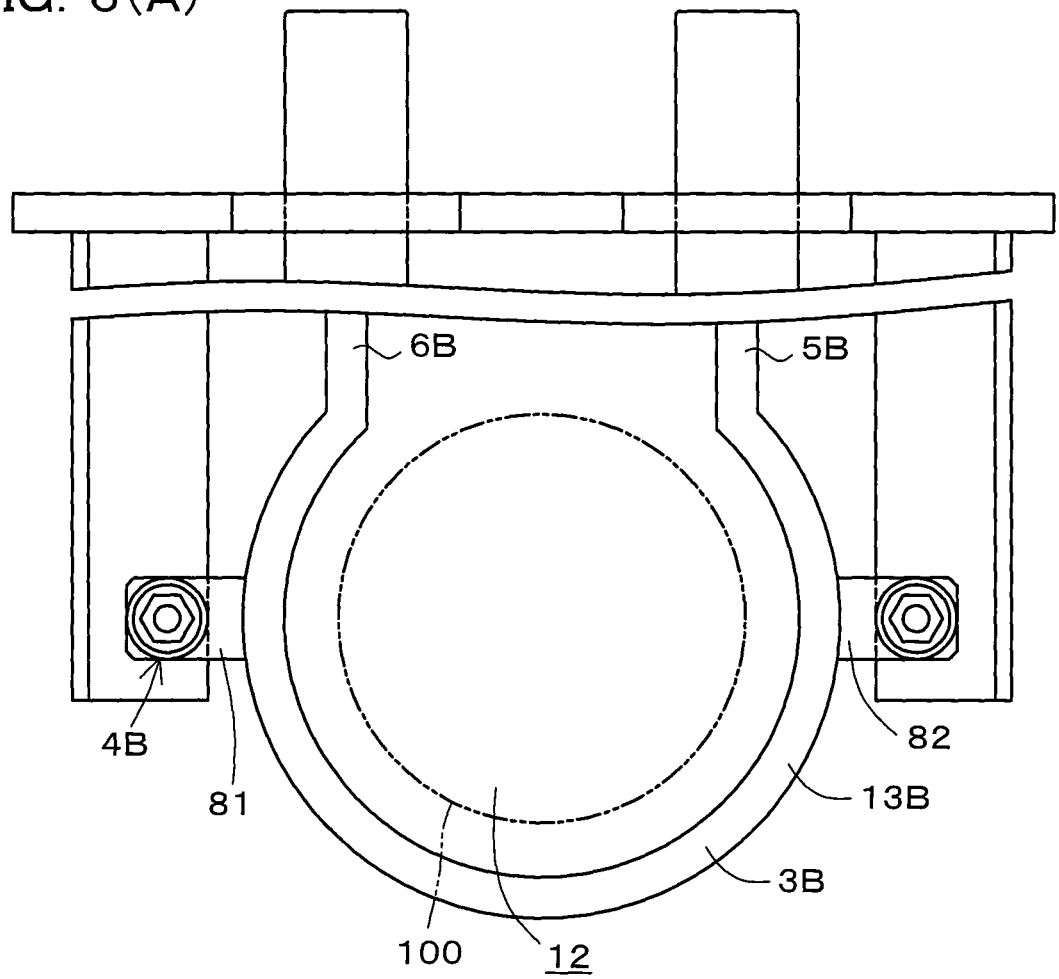
FIG. 6(A) is a plan view.
Figure 6B:
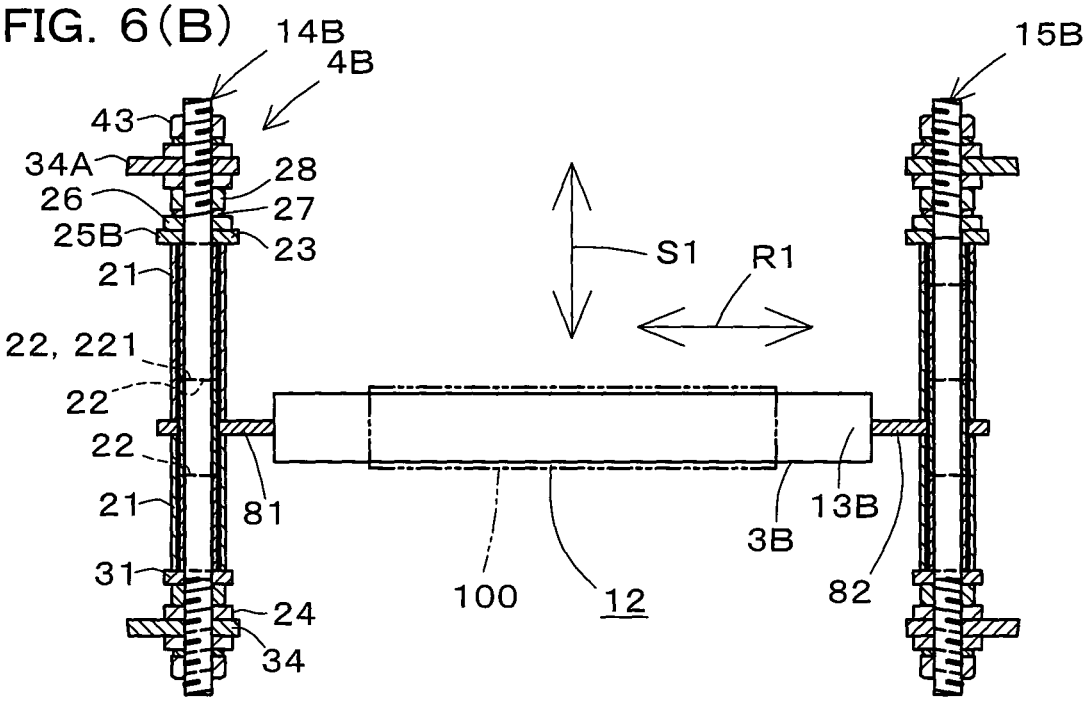
FIG. 6(B) is a side view partially shown in section.

(2) In the embodiment described above, a form in which the induction heating coil 3 has a plurality of windings is described by way of example. However, another form is also possible. For example, as shown in FIG. 6(A) and FIG. 6(B), a supporting structure 4B may be adopted for the induction heating coil 3B having one winding in place of the induction heating coil 3. In the induction heating coil 3B having one winding, at the winding portion 13B, due to a Lorentz force, etc., the winding portion 13B may be displaced in the axial direction S1 with respect to linear relay portions 5B and 6B. As the winding portion 13B of the induction heating coil 3B, one is provided in an arc shape, and at a portion surrounded by this winding portion 13B, the workpiece disposing region 12 is provided. On the winding portion 13B, extended portions 81 and 82 are provided.

The unit 14B of the supporting structure 4B is configured to support, for example, one extended portion 81, and further, the unit 15B of the supporting structure 4B is configured to support, for example, one extended portion 82. In this case, the unit 14B of the supporting structure 4B includes a pair of restricting members 21 and three insulating members 22. One restricting member 21 is disposed between the extended portion 81 and an end portion presser member 25B. The end portion presser member 25B is provided in place of the end portion presser member 25, and formed of like material as that of the end portion presser member 25 so as to have a toric shape, and receives one restricting member 21 and the insulating member 22 on one end side. The other restricting member 21 is disposed between the extended portion 81 and an end portion presser member 31. The three insulating members 22 are disposed between the end portion presser members 25B and 31. The insulating member 221 is juxtaposed to the workpiece disposing region 12 in the radial direction R1. On the other hand, the insulating members 22 other than the insulating member 221 are disposed at positions deviating from the workpiece disposing region 12 in the axial direction S1.

In this case, the insulating member 221 reaches a high temperature in its entirely, so that bias of heat distribution inside is small. Therefore, a thermal impact (internal force) caused by bias of heat inside the insulating member 221 is small. The insulating members 22 other than the insulating member 221 are disposed further away from the workpiece disposing region 12. Therefore, the amount of radiation heat applied to the insulating members 22 other than the insulating member 221 from the workpiece 100 is small, so that these insulating members 22 do not reach a high temperature in their entirely, and bias of heat distribution inside the insulating members 22 is small. Therefore, a thermal impact (internal force) caused by bias of heat inside the insulating members 22 other than the insulating member 221 is small. As a result, a load on each of the plurality of insulating members 22 caused by heat is small, so that the life of the supporting structure 4B can be made longer. In the modification shown in FIG. 6(A) and FIG. 6(B), three insulating members 22 are provided, however, it is also possible that one insulating member is disposed between the end portion presser members 25B and 31.

(3) In the embodiment described above, a form in which the extended portion 81 of the induction heating coil 3 is supported is described. However, another form is also possible. For example, as shown in a schematic partial sectional view in FIG. 7, a restricting member 21C to be disposed among winding portions 13 of the coil main body 7 of the induction heating coil 3 may be provided.

A unit 14C includes a supporting column 20, a restricting member 21C, one end side unit 23, and the other end side unit 24. The one-end side unit 23C has the same configuration as that of the one-end side unit 23 except that a toric end portion presser 25C is provided in place of the end portion presser member 25. The restricting member 21C includes a cylindrical main body portion 45 to be fitted to the supporting column 20, and block-shaped receiving portions 46 that extend from the main body portion 45 and receive the winding portions 13 of the coil main body 7.

One end of the main body portion 45 is received by the end portion presser member 25C, and the other end of the main body portion 45 is received by the end portion presser member 31. The receiving portions 46 are provided the same number equal to the number obtained by adding 1 to the number of winding portions 13. The receiving portions 46 adjacent to one end portion 7*a* and the other end portion 7*b* of the coil main body 7 receive corresponding winding portions 13 so as to sandwich the coil main body 7. Each of the receiving portions 46 at an intermediate portion in the axial direction S1 is disposed between the winding portions 13 adjacent to each other in the axial direction S1, and is in contact with corresponding two winding portions 13. Accordingly, each winding portion 13 is restricted from being displaced in the axial direction S1.

The restricting member 21C is formed of like material as that of the restricting member 21. The restricting member 21C is subjected to a load in the axial direction S1 from the coil main body 7, so that the restricting member 21C may be formed of a metal material having an insulating layer formed on a surface. When the restricting member 21C is formed of a metal material, the restricting member 21C is more preferably formed of a non-magnetic material such as an austenite-based stainless steel material.

Figure 7:
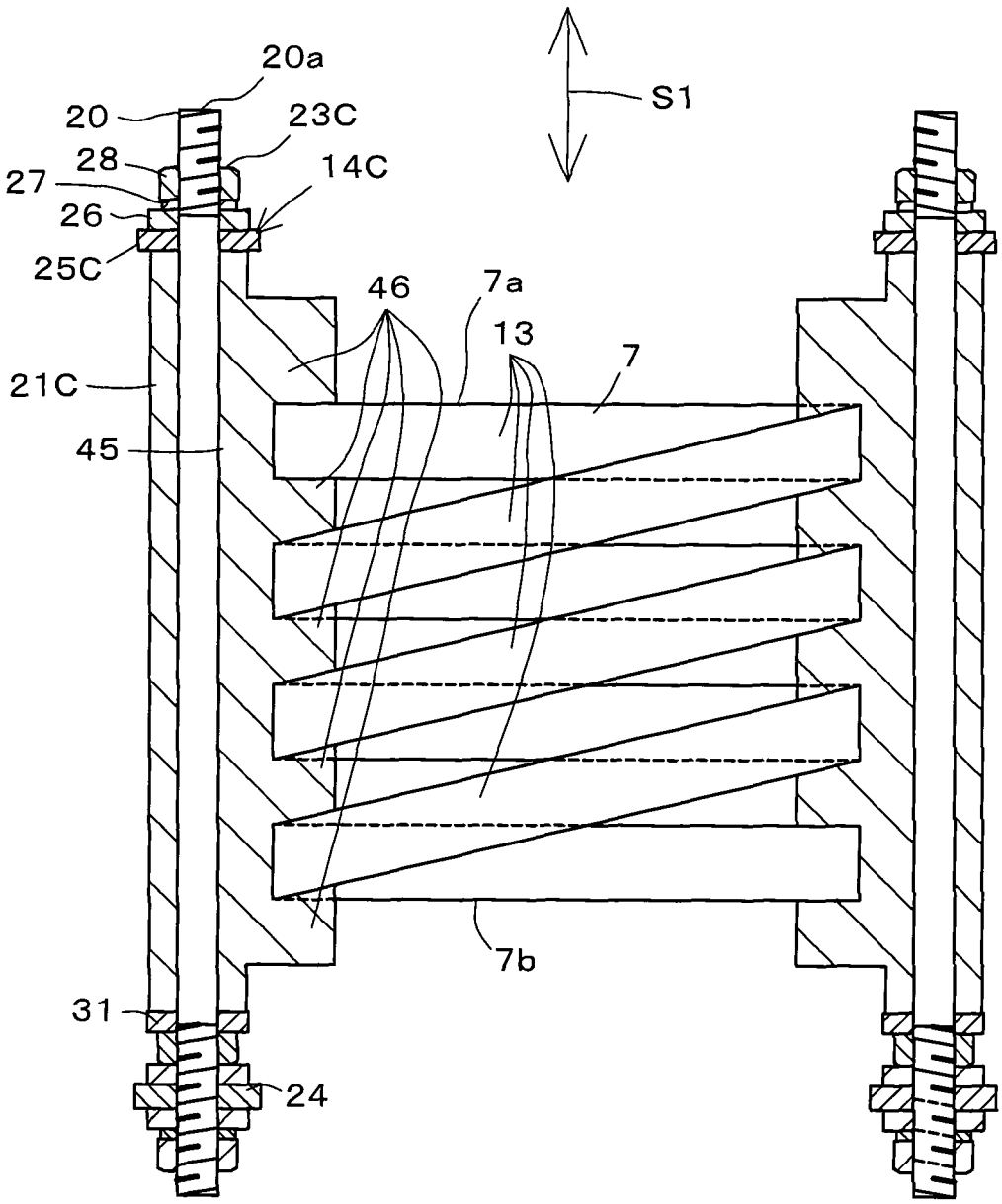
FIG. 7 is a schematic view of a principal portion to describe still another modification, partially shown in section.

In the modification shown in FIG. 7 described above, a form in which the main body portion 45 and the receiving portions 46 are molded integrally in the restricting member 21C is described by way of example. However, another form is also possible.

Figure 8B:
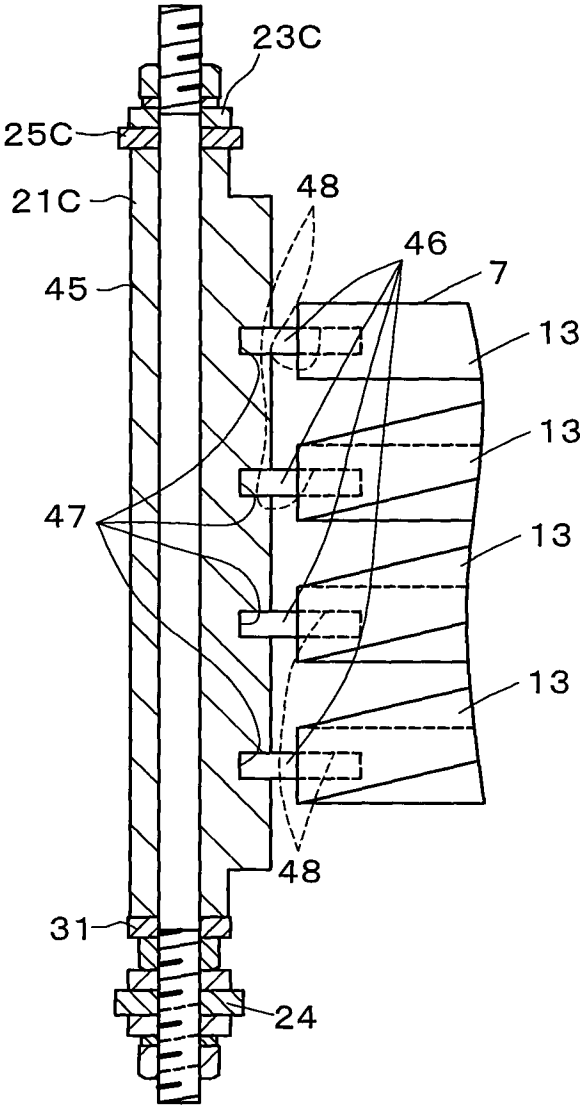
FIG. 8(A) and FIG. 8(B) are respectively schematic views of a principal portion to describe still another modification, partially shown in section.
Figure 8A:
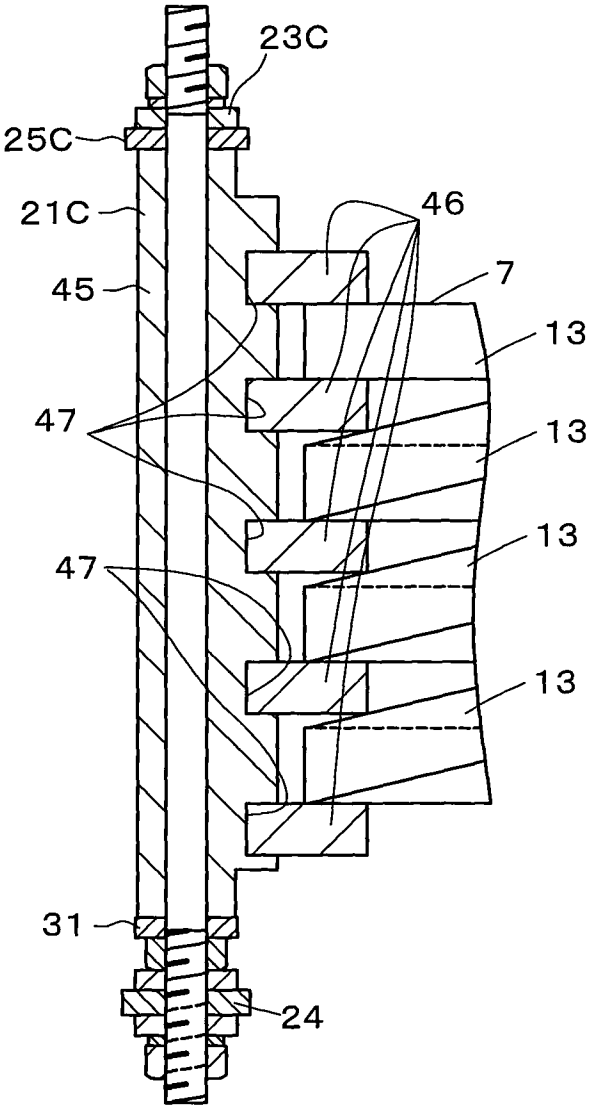

(4) For example, as shown in FIG. 8(A) and FIG. 8(B), in the restricting member 21C, the main body portion 45 and the receiving portions 46 may be formed of separate members. In this case, the receiving portions 46 are fixed to groove-shaped holding port ions 47 formed in the main body portion 45 by press fitting, etc. In the modification shown in FIG. 8(A), the receiving portions 46 receive side surfaces facing the axial direction S1 in the winding portions 13. On the other hand, in the modification shown in FIG. 8(B), the receiving portions 46 support the winding portions 13 (coil main body 7) by being inserted into groove-shaped holding portions 48 formed in outer circumferential surfaces of the winding portions 13, and restrict the winding portions 13 from being displaced in the axial direction.

Figure 9A:
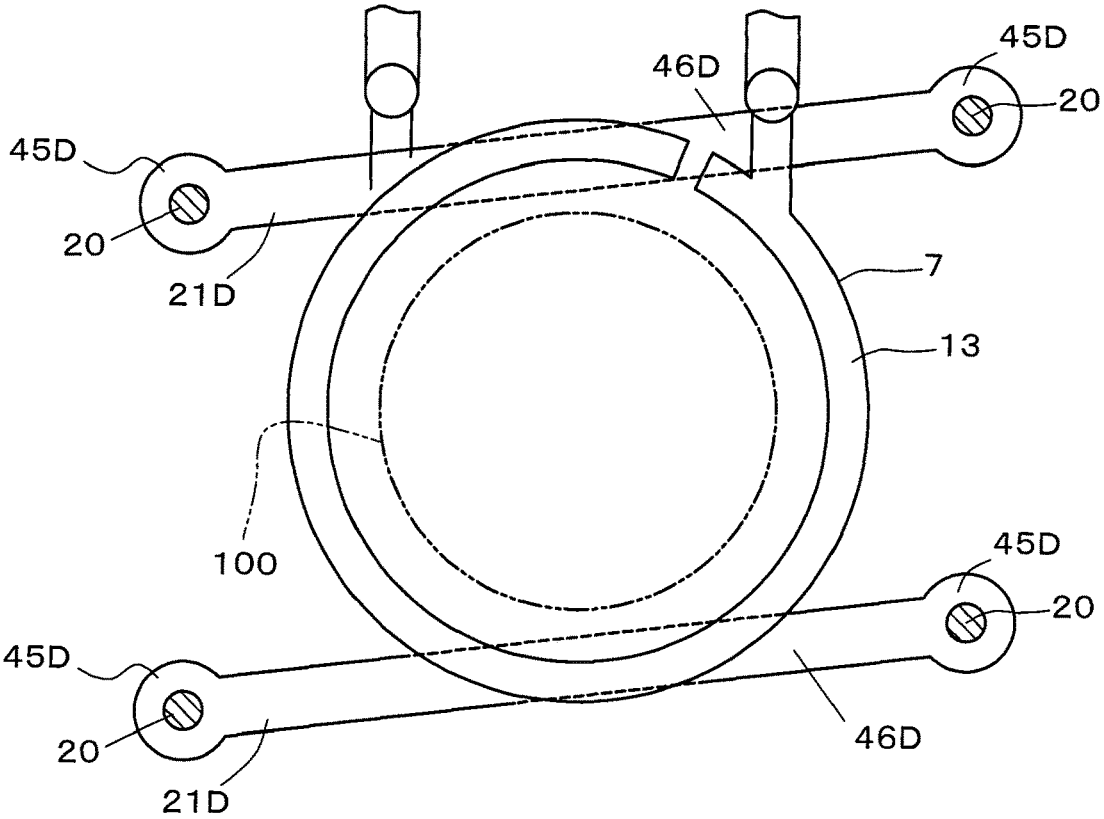
FIG. 9(A) is a schematic plan view of a principal portion, partially shown in section.
Figure 9B:
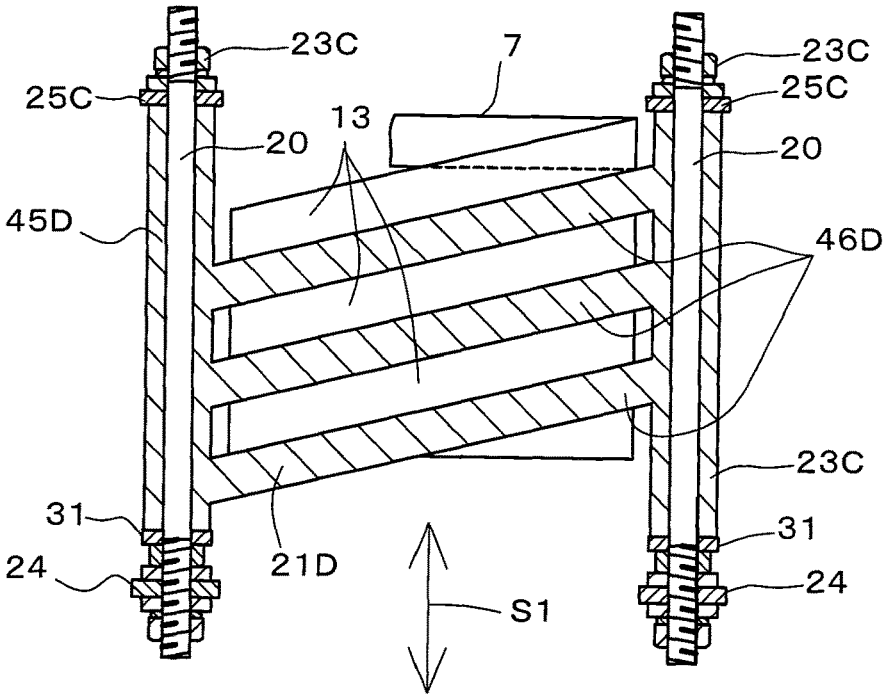
FIG. 9(B) is a schematic side view of the principal portion shown in FIG. 9(A), partially shown in section.

(5) Alternatively, as shown in FIG. 9(A) and FIG. 9(B), a restricting member 21D having a beam-shaped receiving portion 46D supported by a plurality (in FIG. 9, two) of supporting columns 20 may be provided. The restricting member 21D is formed of like material as that of the restricting member 21C. The restricting member 21D includes cylindrical main body portions 45D and 45D to be fitted to the two supporting columns 20 and 20, and beam-shaped receiving portions 46D that extend from these main body portions 45D and 45D and receive the winding portions 13 of the coil main body 7.

A plurality of receiving portions 46D are provided. The receiving portion 46D at an intermediate portion in the axial direction S1 is disposed so as to be sandwiched by the two winding portions 13, and receives a corresponding winding portion 13 at two points in the circumferential direction C1.

Further, in the modification shown in FIG. 9(A) and FIG. 9(B), the supporting columns 20 and 20 and the restricting member 21D supported by these supporting columns 20 and 20 are provided in pairs. That is, four supporting columns 20 and two restricting members 21D are provided. One restricting member 21D and the other restricting member 21D are disposed away from each other in the circumferential direction C1. Accordingly, each winding portion 13 is restricted from being displaced in the axial direction S1.

In the restricting member 21D, the receiving portions 46D are supported at both ends by the main body portions 45D and 45D. Accordingly, the restricting member 21D can be made more rigid to support the coil main body 7. As a result, the restricting member 21D can more reliably restrict movement of the coil main body 7 in the axial direction S1. Further, by the pair of restricting members 21D and 21D, each of the winding portions 13 is supported at multiple points (in the modification, supported at four points). Accordingly, the restricting members 21D can more reliably restrict movement of the coil main body 7 in the axial direction S1.

(6) The configuration of the modification described above can be equally applied to each of the case where the induction heating coil 3 has one winding and the case where the induction heating coil 3 has a plurality of windings.

(7) In the above-described embodiment and modifications, a case where the supporting column and the restricting members are separate from each other is described. However, the supporting column and the restricting members may be integrally molded.

(8) In the above-described embodiment and modifications, a form in which the surface of the induction heating coil 3 or 3B is not an insulation coating film is described by way of example. However, another form is also possible. For example, the present invention is also applicable to an induction heating coil whose surface is formed of an insulation coating film.

(9) In the above-described embodiment and modifications, a form in which the winding portions 13 or 13B of the induction heating coil 3 or 3B are circular is described by way of example. However, another form is also possible. For example, even when the number of windings of the spiral induction heating coil is other than 1 or even when the number of windings is other than a plural number, the induction heating coil may be supported by the supporting structure of the present invention. The supporting structure of the present invention may be applied to support an induction heating coil, as the induction heating coil, such as an induction heating coil including winding portions having arc shapes as portions of circles, and an induction heating coil including winding portions partially formed linearly.

(10) An embodiment and modifications of the present invention are described above. However, the present invention is required to include a supporting column and a restricting member supported by this supporting column, and other configurations are not particularly limited.

INDUSTRIAL APPLICABILITY

The present invention is widely applicable as a supporting structure for an induction heating coil, and an induction heating device.

REFERENCE SIGNS LIST

1: Induction heating device
2: Base member
3, 3B: Induction heating coil
4, 4B: Supporting structure
7: Coil main body
12: Workpiece disposing region
13, 13B: Winding portion
20: Supporting column
21, 21C, 21D: Restricting member
22: Insulating member
34, 34A: Stay
81, 82: Extended portion (portions adjacent to each other in axial direction in induction heating coil)
100: Workpiece
P22: Position of butting portion between insulating members
R1: Radial direction
S1: Axial direction

What is claimed is:

1. A supporting structure for an induction heating coil comprising:

a supporting column disposed at an outer side in a radial direction of winding portion of an induction heating coil and extending in an axial direction of the induction heating con; and a plurality of first insulating members which receive the induction heating coil in an insulated state to restrict movement of the induction heating coil in the axial direction, and supported by the supporting column, wherein the induction heating coil includes a coil main body having the winding portion and an extended portion extending outward in the radial direction from the coil main body, the plurality of first insulating members sandwich the extended portion in the axial direction, the supporting structure for the induction heating coil further comprises a plurality of second insulating members interposed between the supporting column and the extended portion, wherein the plurality of second insulating members are aligned in the axial direction, the second insulating members adjacent to each other directly contact each other, and a position of an abutting portion between the plurality of second insulating members deviates in the axial direction from a position of the extended portion of the induction heating coil.

2. The supporting structure for an induction heating coil according to claim 1, wherein the coil main body has a spiral shape and includes a plurality of the winding portions, the extended portion is provided on each of the winding portions, the plurality of the extended portions are aligned along the axial direction, and the first insulating member is disposed between a pair of the extended portions adjacent to each other in the axial direction.

3. The supporting structure for an induction heating coil according to claim 1, wherein the first insulating member is formed into a cylindrical shape and fitted to the supporting column.

4. The supporting structure for an induction heating coil according to claim 1, wherein in the induction heating coil, a workpiece disposing region in which a workpiece is disposed is set, and in the supporting column, some second insulating members of the plurality of second insulating members are juxtaposed to the workpiece disposing region in the radial direction, and the other second insulating members of the plurality of second insulating members are positionally deviated from the workpiece disposing region in the axial direction.

5. The supporting structure for an induction heating coil according to claim 1, further comprising:

a stay configured to support the supporting column and supported by a predetermined base member.

6. An induction heating device comprising:

an induction heating coil; and the supporting structure configured to support the induction heating coil, according to claim 1.

* * * * *